US007743951B2

(12) United States Patent
Vogel et al.

(10) Patent No.: US 7,743,951 B2
(45) Date of Patent: Jun. 29, 2010

(54) CONTAINER

(75) Inventors: William C. Vogel, Mequon, WI (US); Terrence M. Parve, Menomonee Falls, WI (US); Gary Swetish, Racine, WI (US); Michael Phillips, Milwaukee, WI (US)

(73) Assignee: Gateway Plastics, Inc., Mequon, WI (US)

( * ) Notice: Subject to any disclaimer, the term of this patent is extended or adjusted under 35 U.S.C. 154(b) by 889 days.

(21) Appl. No.: 11/177,232

(22) Filed: Jul. 8, 2005

(65) Prior Publication Data

US 2006/0027581 A1 Feb. 9, 2006

Related U.S. Application Data

(63) Continuation-in-part of application No. 10/764,819, filed on Jan. 26, 2004, now Pat. No. 7,258,255, which is a continuation-in-part of application No. 10/020,581, filed on Dec. 14, 2001, now Pat. No. 6,691,901.

(60) Provisional application No. 60/586,491, filed on Jul. 8, 2004, provisional application No. 60/442,786, filed on Jan. 27, 2003.

(51) Int. Cl.
*B65D 47/00* (2006.01)

(52) U.S. Cl. ..... 222/556; 222/153.06; 222/153.07; 222/465.1; 222/541.9; 222/566; 220/257.2; 220/266; 215/901

(58) Field of Classification Search ..... 222/465.1, 222/556, 541.9, 562, 566–567, 153.01, 153.05, 222/153.06, 153.07; 220/257.1, 257.2, 258.4, 220/258.5, 266; 215/901
See application file for complete search history.

(56) References Cited

U.S. PATENT DOCUMENTS 3,255,928 A * 6/1966 Foster ..... 222/153.07
3,262,606 A 7/1966 Waterman (Continued)

OTHER PUBLICATIONS

Graphic Images: Closure #14, document No. 001.1597652 (date unknown and presumed by Applicants to be prior art; Applicants reserve the right to establish a date at a future time), 1 page.

*Primary Examiner*—Frederick C. Nicolas
(74) *Attorney, Agent, or Firm*—Foley & Lardner LLP

(57) ABSTRACT

A container having a receptacle and a cover is disclosed. The receptacle includes a generally rectangular base portion, a continuous sidewall portion, and a collar. The sidewall portion includes a lower end and an upper end. The lower end of the sidewall portion is coupled to the base portion and the upper end defines an opening. The collar extends around the sidewall portion proximate the upper end. The cover is coupled to the receptacle and includes a top portion, a skirt, a flap, and a tear strip. The skirt extends downwardly from the periphery of the top portion. The flap is hingably coupled to the top portion proximate a corner of the closure and is moveable between an open position in which access is provided to the opening in the receptacle and a closed position in which the opening in the receptacle is closed. The flap includes a closing apparatus to releasably retain the flap in the closed position. The tear strip is removable and is coupled to the flap and the skirt. The tear strip substantially prevents the flap from being moved into the open position until the tear strip is removed.

20 Claims, 19 Drawing Sheets

U.S. PATENT DOCUMENTS 3,469,732 A 9/1969 Foster
3,542,235 A 11/1970 Hidding
3,604,805 A 9/1971 Scott
3,872,996 A 3/1975 Dogliotti
4,286,713 A * 9/1981 Marchais ..... 206/508
4,779,756 A 10/1988 Buelens et al.
5,579,957 A 12/1996 Gentile et al.
5,836,467 A 11/1998 Montgomery
5,896,993 A * 4/1999 Nask et al. ..... 206/508
6,035,345 A * 3/2000 Lee ..... 710/8
6,109,487 A * 8/2000 Hashimoto ..... 222/556
6,422,411 B1 * 7/2002 Gray ..... 220/254.2
6,660,349 B1 12/2003 Bourgeois
6,691,901 B2 2/2004 Parve et al.
6,692,685 B1 2/2004 Willingham
7,021,482 B2 * 4/2006 Solowiejko ..... 220/254.2
2006/0144874 A1 * 7/2006 Solowiejko ..... 222/480

* cited by examiner

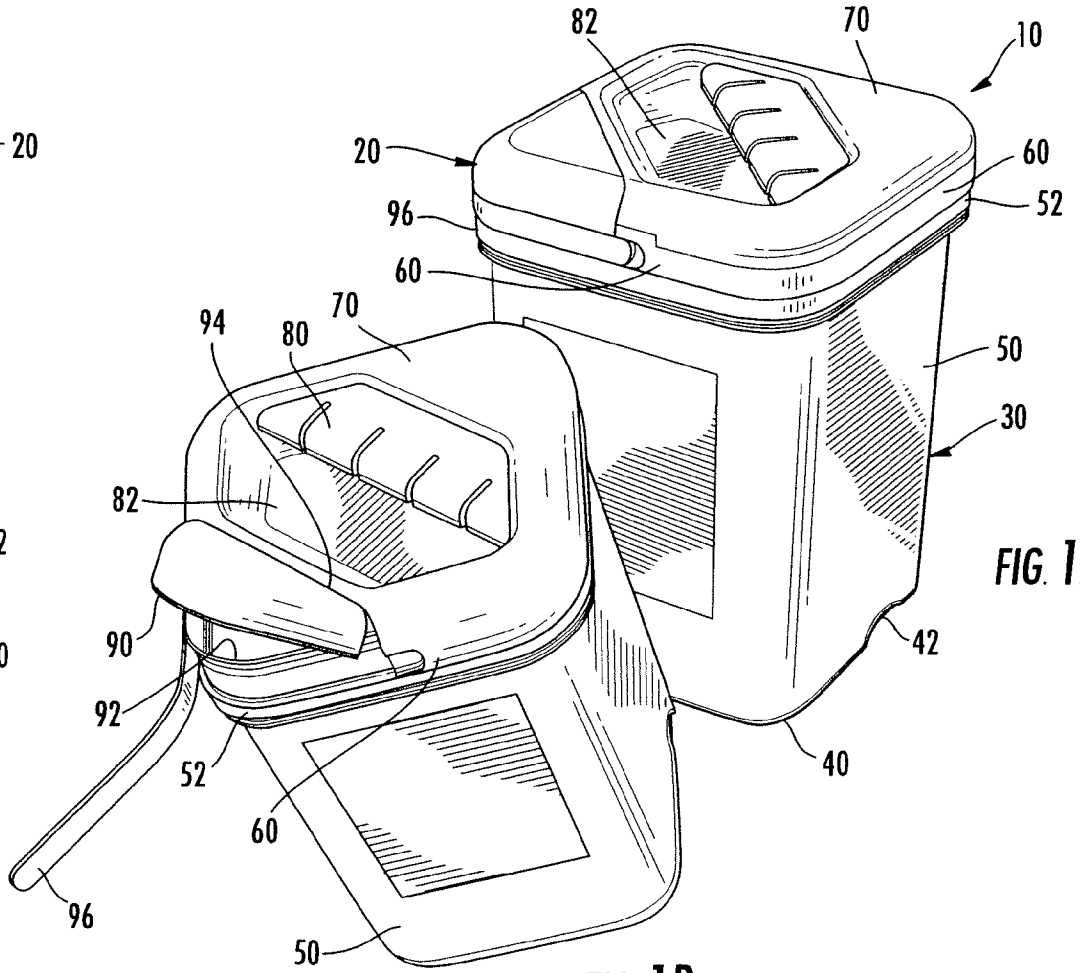
FIG. 1A
FIG. 1B
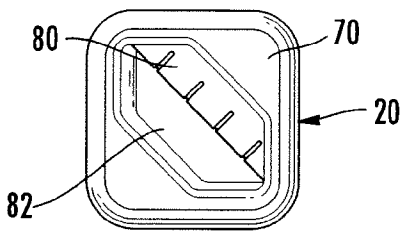
FIG. 1C
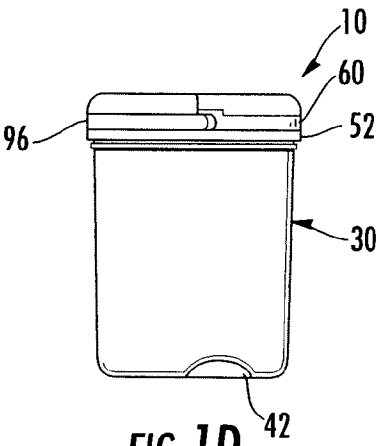
FIG. 1D

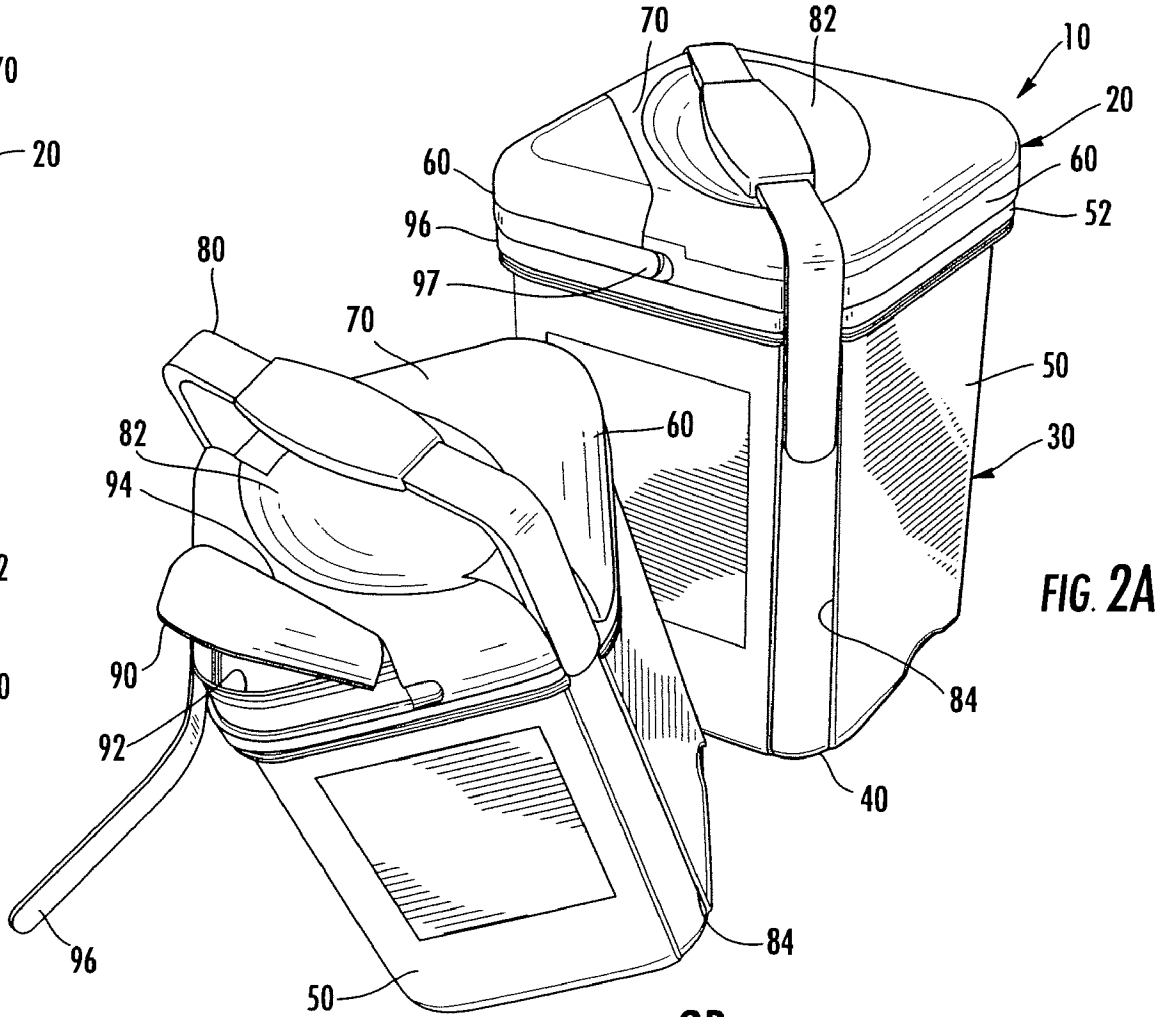
FIG. 2A
FIG. 2B
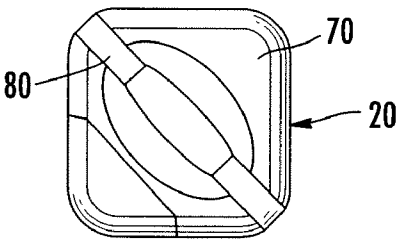
FIG. 2C
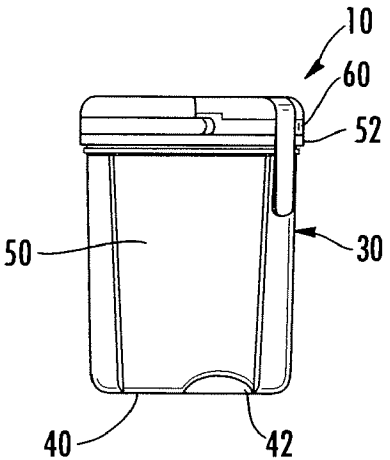
FIG. 2D

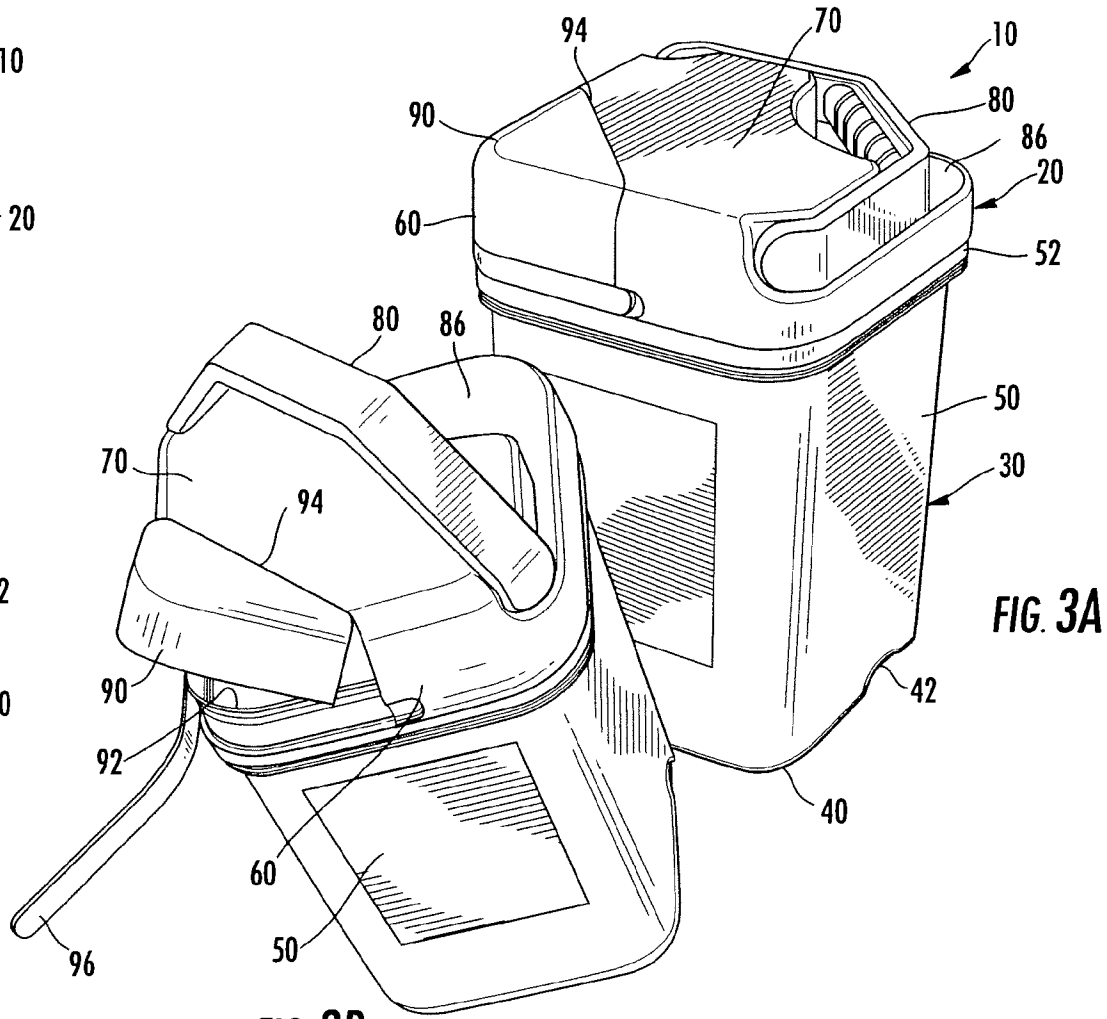
FIG. 3A
FIG. 3B
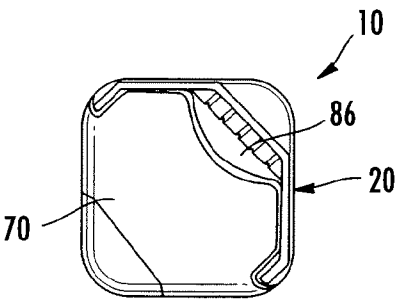
FIG. 3C
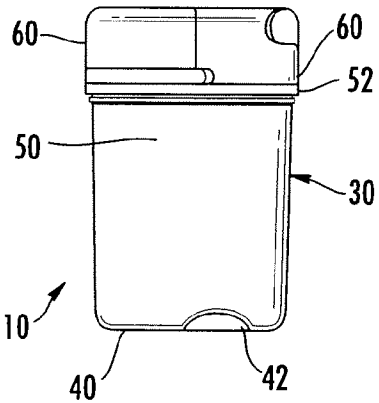
FIG. 3D

CONTAINER

CROSS REFERENCE TO RELATED APPLICATIONS

This application claims priority to and the benefit of U.S. Provisional Patent Application No. 60/586,491, filed on Jul. 8, 2004, entitled "Container," which is incorporated by reference herein. This application is a continuation-in-part of U.S. patent application Ser. No. 10/764,819 titled "Closure for a Container," filed Jan. 26, 2004, now U.S. Pat. No. 7,258,255, which is a continuation-in-part of U.S. patent application Ser. No. 10/020,581 titled "Closure for a Container" filed on Dec. 14, 2001, now U.S. Pat. No. 6,691,901, and which claims priority to and the benefit of U.S. Provisional Patent Application No. 60/442,786 titled "Closure for a Container" filed on Jan. 27, 2003.

FIELD

The present invention(s) relate to a container. The present invention(s) more specifically relate to a container for retaining matter and for dispensing the matter.

BACKGROUND

It is known to provide for containers that may be used for retaining and dispensing matter. Such known containers do not realize certain advantageous features (and/or combination of features).

BRIEF DESCRIPTION OF THE DRAWINGS

FIGS. 1A-1D illustrate different views of a container according one exemplary embodiment.

FIGS. 2A-2D illustrate different views of a container according another exemplary embodiment.

FIGS. 3A-3D illustrate different views of a container according another exemplary embodiment.

DETAILED DESCRIPTION OF EXEMPLARY EMBODIMENTS

Figures 4A, 4B, 4C, 4D:
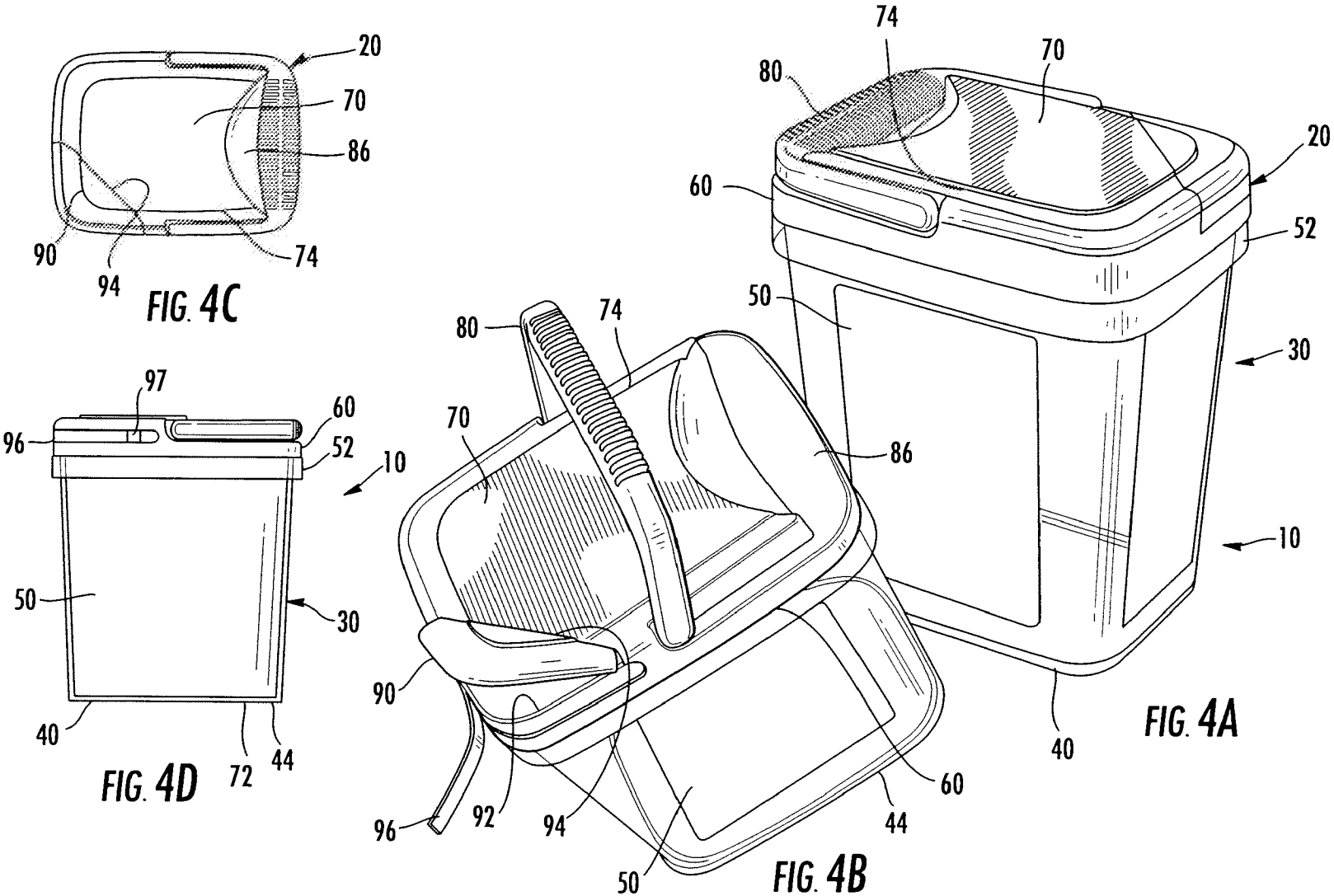
FIGS. 4A-4D illustrate different views of a container according another exemplary embodiment.
Figures 5A, 5B, 5C, 5D:
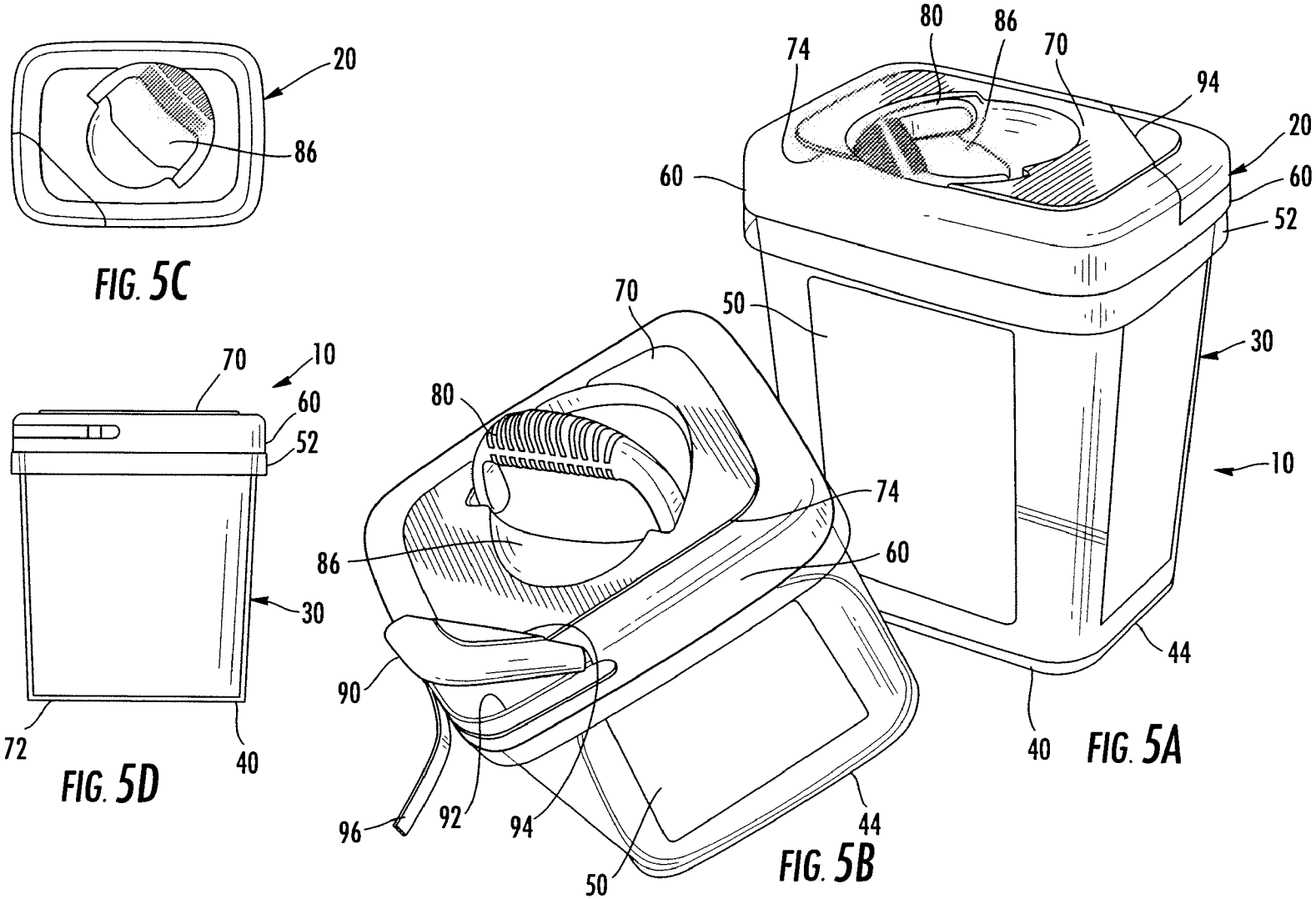
FIGS. 5A-5D illustrate different views of a container according another exemplary embodiment.
Figures 6A, 6B, 6C, 6D:
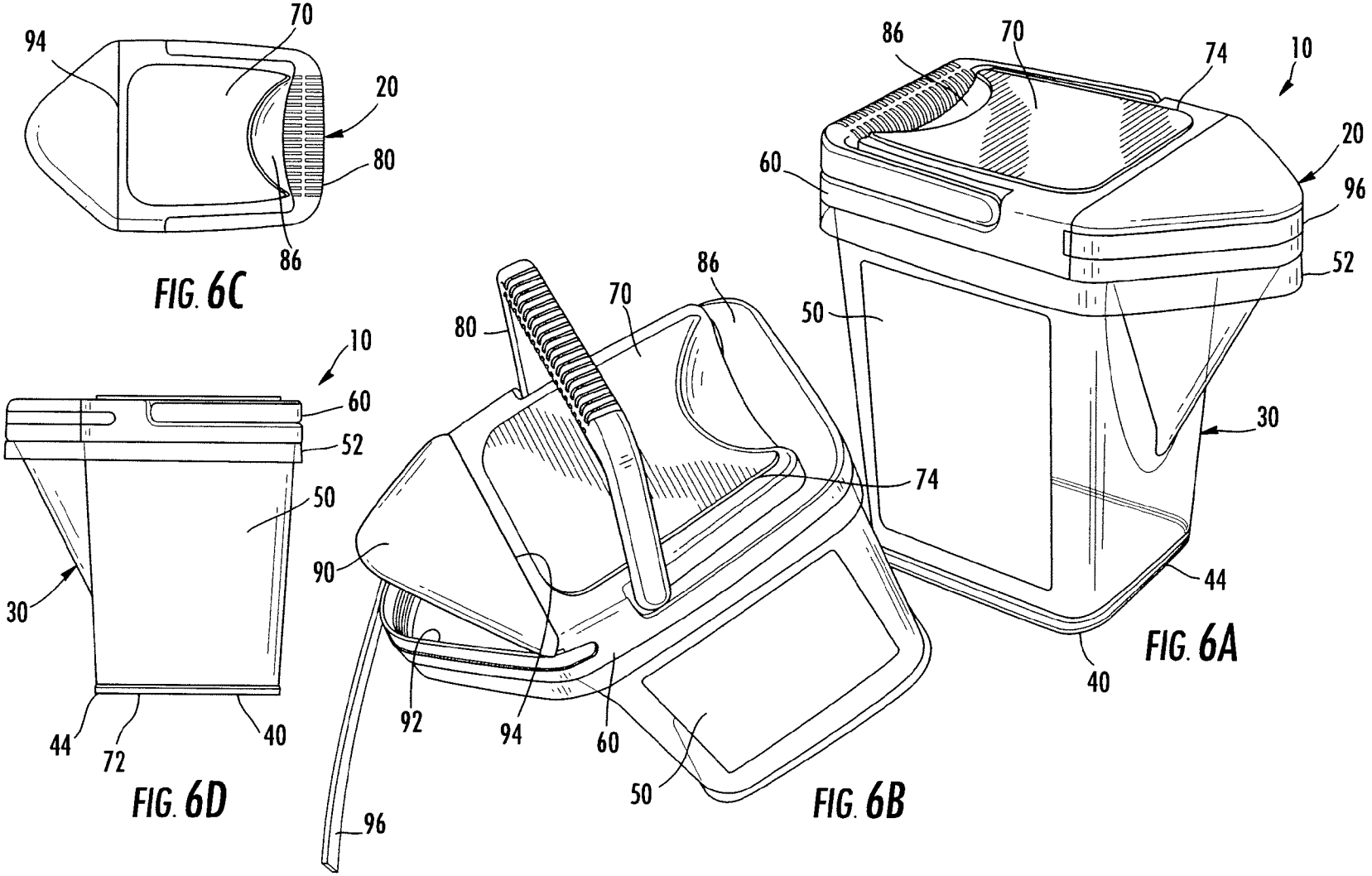
FIGS. 6A-6D illustrate different views of a container according another exemplary embodiment.
Figures 7A, 7B, 7C, 7D:
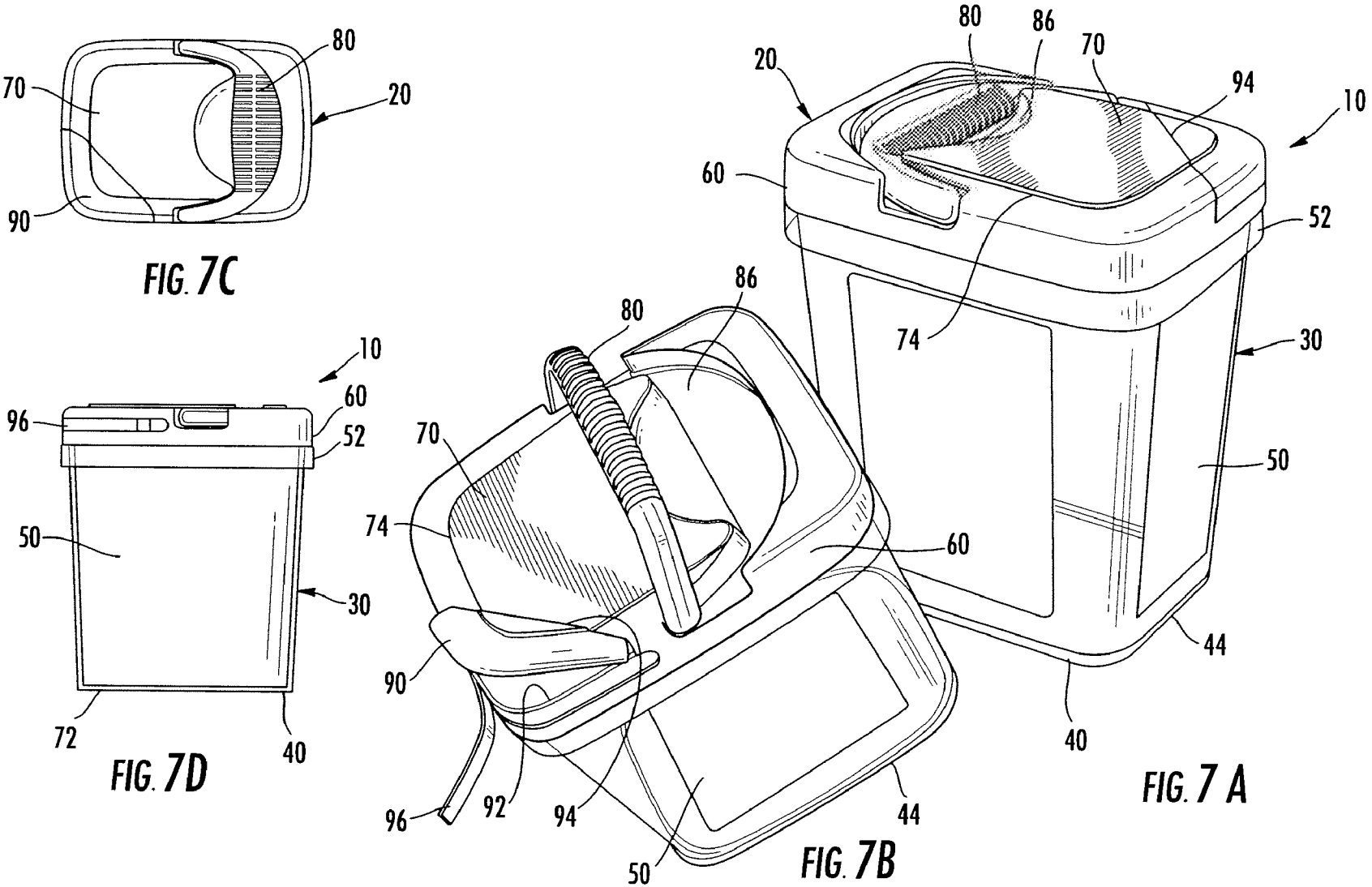
FIGS. 7A-7D illustrate different views of a container according another exemplary embodiment.
Figure 8A:
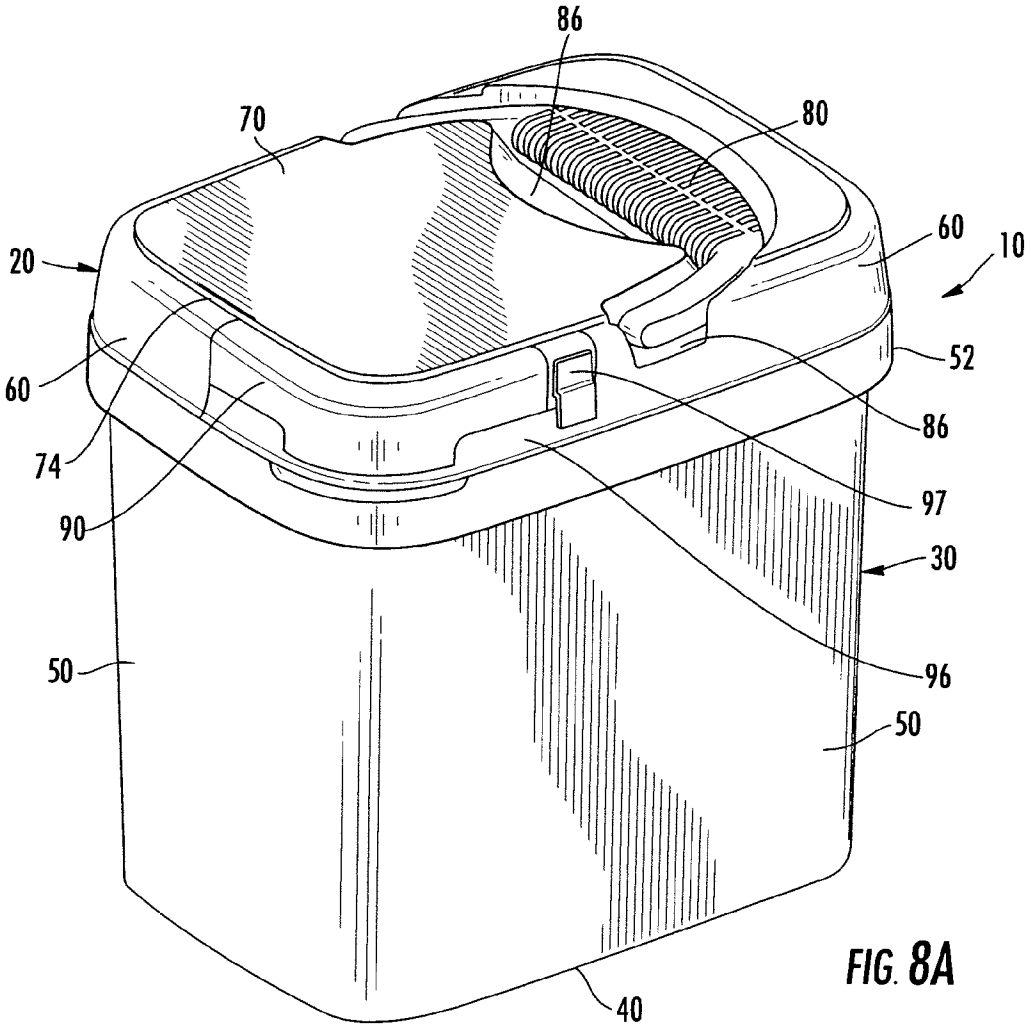
FIGS. 8A-8C illustrate different views of a container according another exemplary embodiment.
Figure 8B:
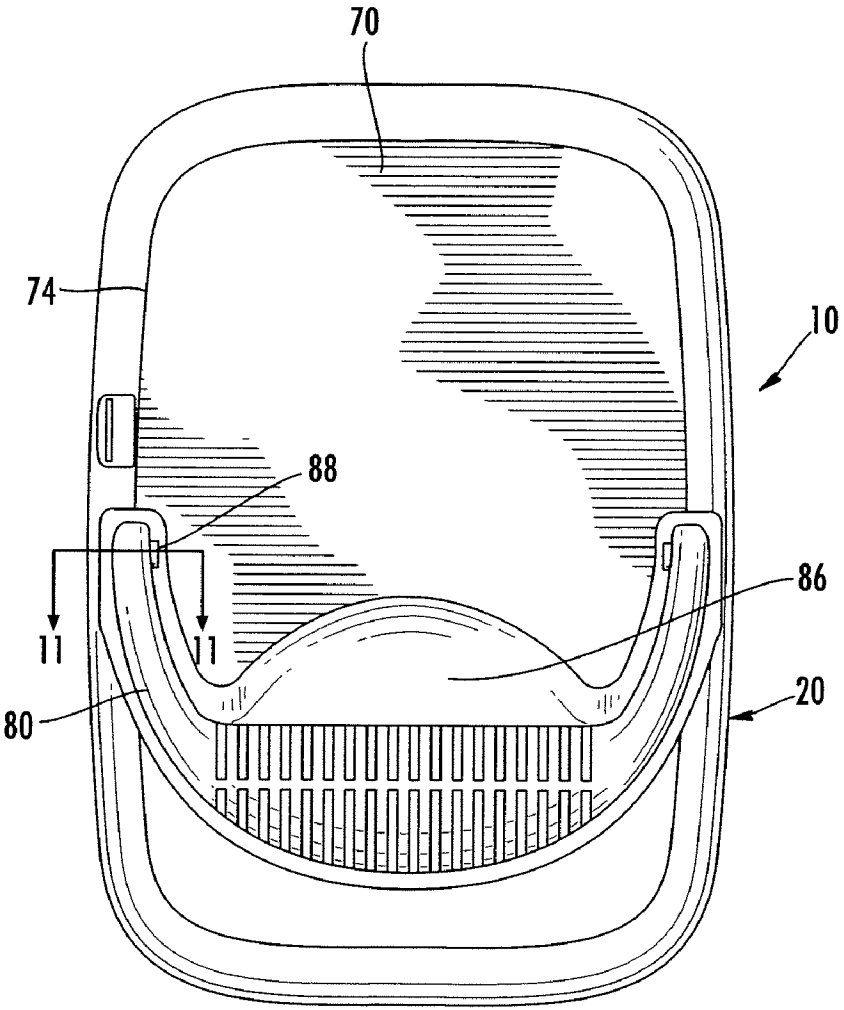
Figure 8C:
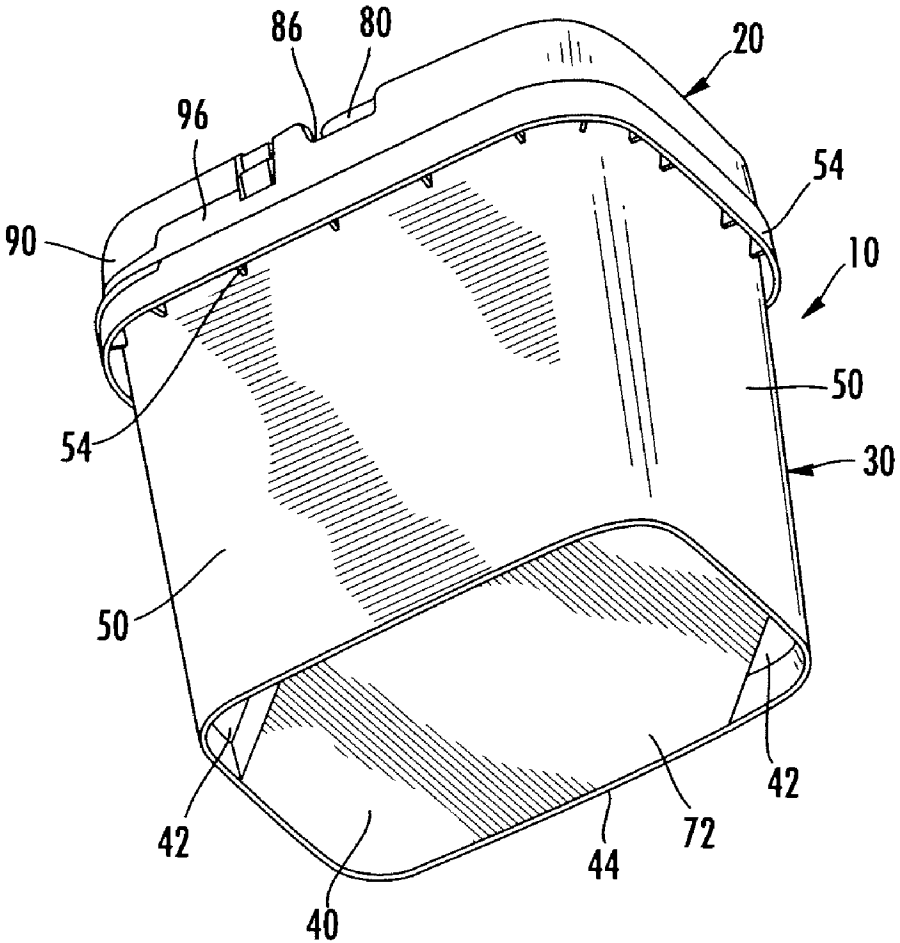
Figure 9:
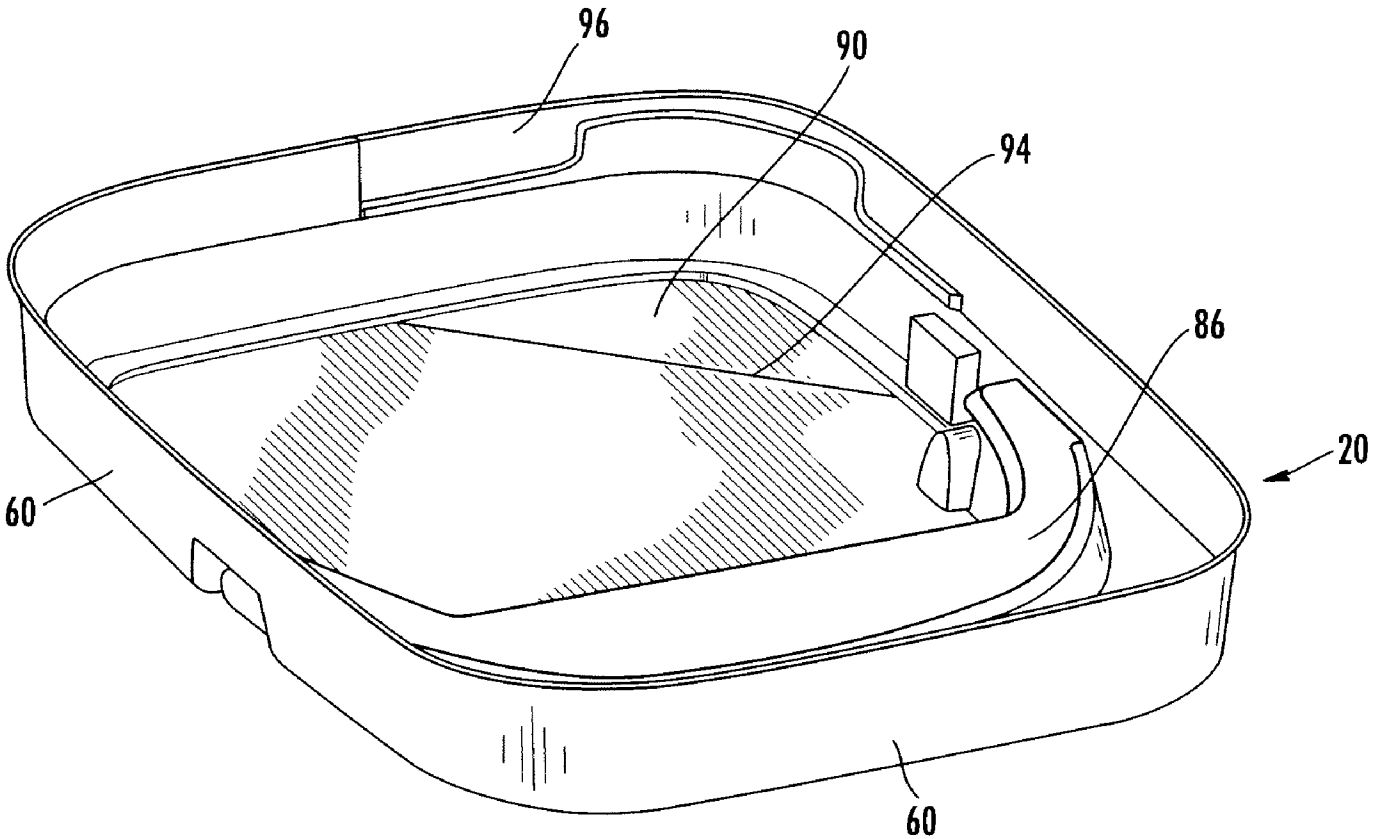
FIG. 9 illustrates the closure of the container illustrated in FIGS. 8A-8C.

According to various exemplary embodiments shown in the FIGURES, a container 10 may be provided for receiving, holding, storing, transporting, and dispensing various matters or substances, in particular, granular or particulate matter (e.g., pet food, cat litter, etc.). Container 10 may also be provided for use with other types of matter such as liquids, chemicals, or any other viscous materials or fluids. According to various exemplary and alternative embodiments shown in the FIGURES, container 10 may comprise a closure 20 (e.g., cap, cover, etc.) and a receptacle 30 (e.g., bottle, pail, bucket, etc.).

Receptacle 30 may be provided for receiving, holding, storing, transporting, etc. a wide variety of different materials and substances. According to various exemplary embodiments, receptacle 10 generally includes a bottom 40, sidewalls 50, and a collar 52.

As shown in FIGS. 1A-7D, 8C, and 10A-10C, bottom 40 of receptacle 30 is a generally flat, rectangular, panel. According to various exemplary embodiments, bottom 40 may include one or more indentations or recesses 42 that facilitate the handling of receptacle 30 by a user. For example, indentations or recesses 42 may be configured and located such that a user may insert his or her fingers into recesses 42 as he or she picks up receptacle 30 or tips it one way or the other, such as to pour out the contents of receptacle 30. The location of indentations or recesses 42 within bottom 40 of receptacle 30 may depend on certain characteristics of closure 10, such as the orientation or location of a handle (discussed below) and/or the orientation and location of an opening (discussed below) in closure 10 configured to allow a user to selectively remove the contents of receptacle 30. According to one exemplary embodiment, at least one indentation or recess 42 is located such that a user may place one hand on a handle of closure 10 and grasp indentation 42 with the other hand to pour or dispense the contents of container 10 out of the opening in closure 10.

According to other exemplary embodiments, such as those shown in FIGS. 4A-7D and 8C, bottom 40 may include a lip or rim 44 around the periphery of bottom 40 that a user may grasp when handling receptacle 30 or pouring the contents of receptacle 30.

As shown in FIGS. 1A-8A, 8C, and 10A-10C, sidewalls 50 are substantially flat and rigid panels or members that extend generally perpendicularly from the periphery of bottom 40 to form a substantially rectangular shaped tube that is closed on one end by bottom 40. The intersection between the different sidewalls 50 (e.g., the "corners" of the receptacle) may be a sharp corner, or may be radiused to provide a more gradual transition between sidewalls 50.

Figure 10A:
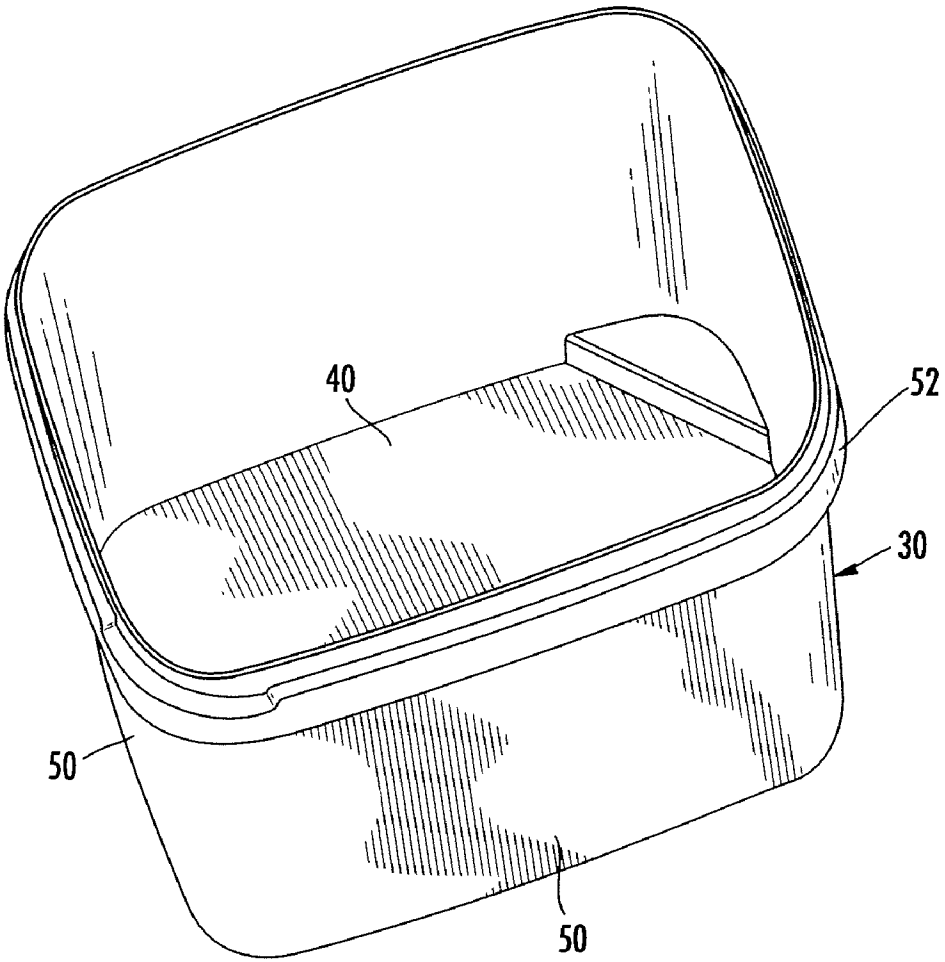
FIGS. 10A-10C illustrate different views of the receptacle of the container illustrated in FIGS. 8A-8C.
Figure 10B:
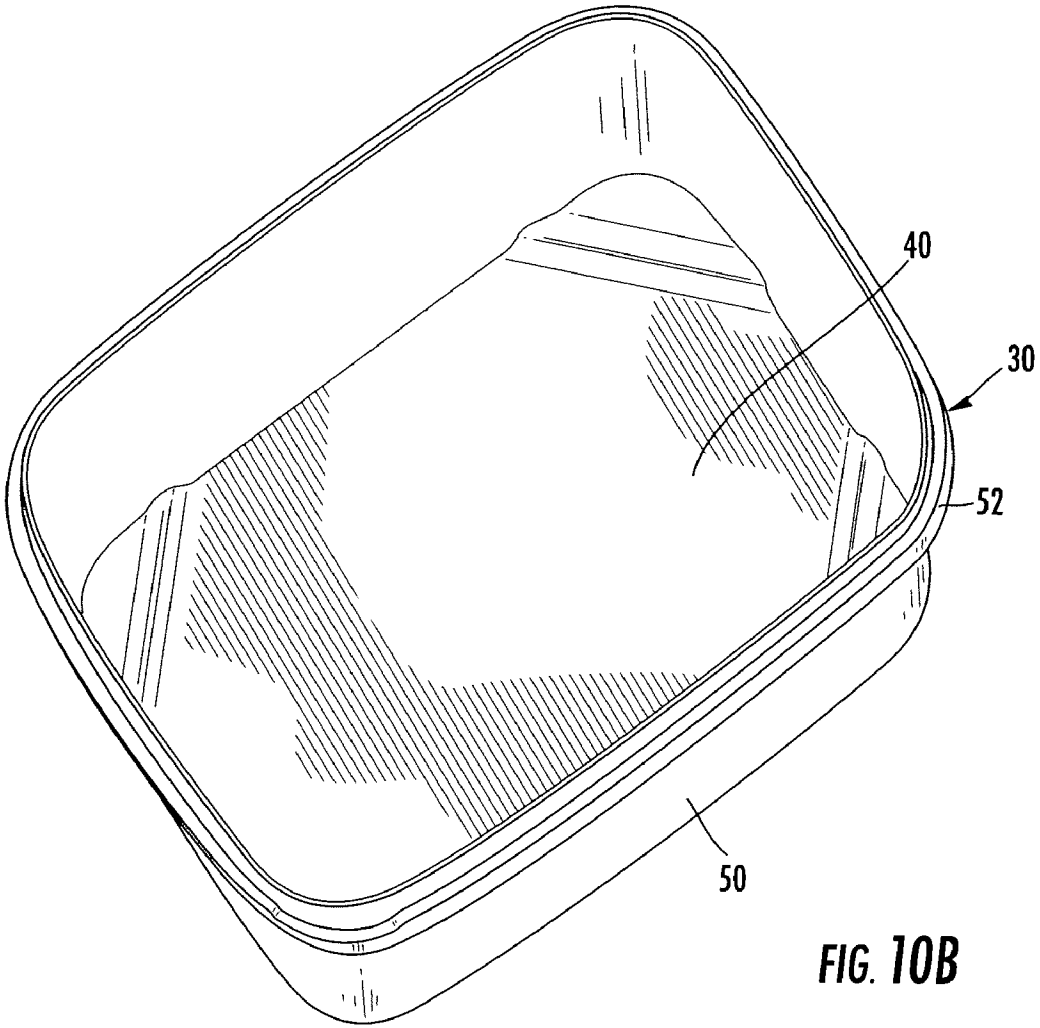
Figure 10C:
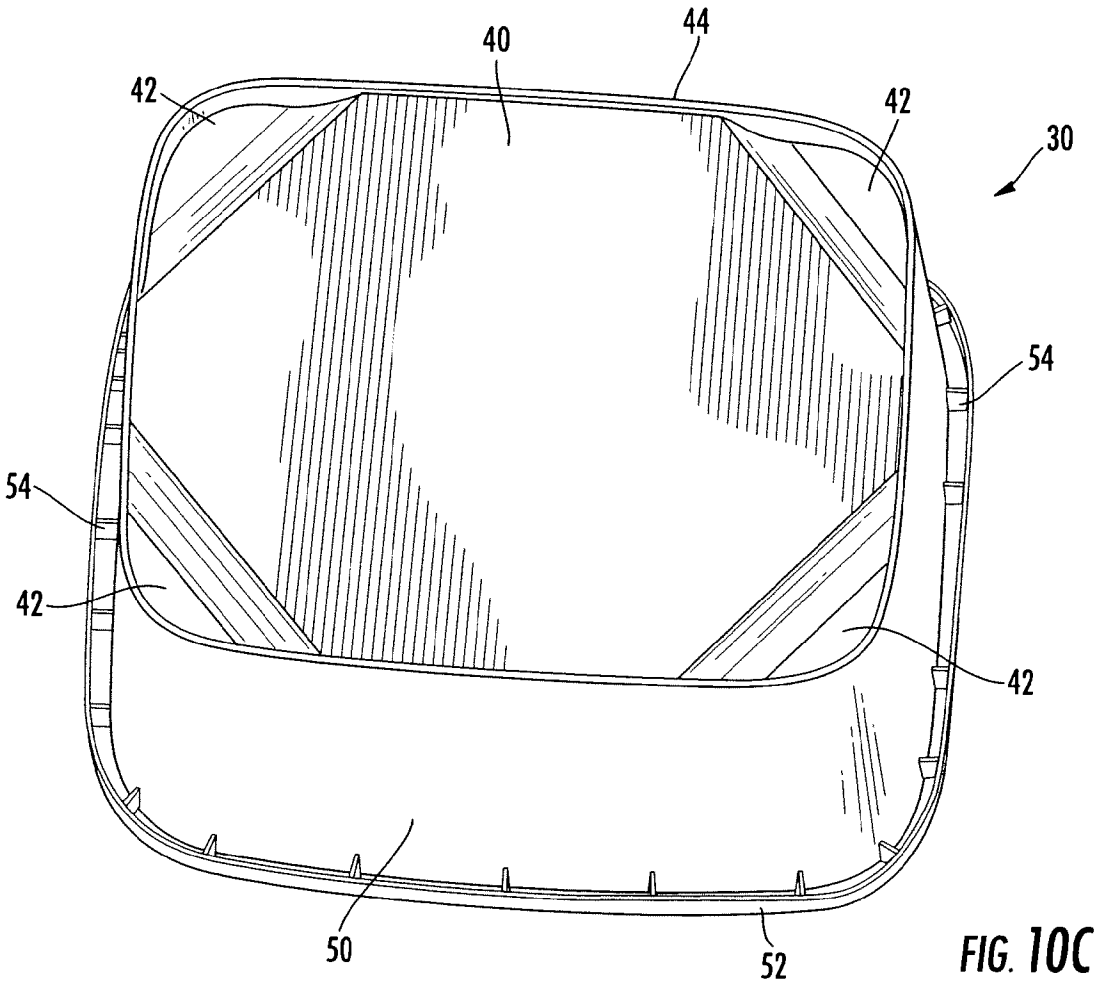

As best shown in FIGS. 10A-10C, a collar or reinforcement member 52 may be provided around the upper edge of sidewalls 50 to provide support for sidewalls 50 and to provide structure to which closure 20 may be coupled. According to various exemplary embodiments, collar 52 generally extends around the periphery of the upper end of sidewalls 50 (i.e. the end of sidewalls 50 opposite bottom 40) and may be solid or may be substantially hollow and include intermittently spaced reinforcing ribs 54 that extend between sidewalls 50 and the inside surface of collar 52. Collar 52 may extend outwardly from sidewalls 50 such that its outer periphery generally follows the outer periphery of closure 20.

According to one exemplary embodiment shown in FIGS. 12A-13, sidewalls 50 (or collar 52) may include one or more projections (e.g., fingers, barbs, locking members, etc.) or recesses 56 proximate the open end of receptacle 30 that are configured to engage corresponding projections or recesses 58 that are provided on closure 20 (see discussion below). The engagement of the projections and/or recesses 56 on receptacle 30 and the projections and/or recesses 58 on closure 20 serves to maintain the coupled condition of receptacle 30 and closure 20, particularly when closure 20 (and a corresponding handle, described below) are called upon to support the weight of container 10 and its contents.

A closure 20 may be provided for generally protecting, sealing, enclosing, and/or selectively closing an open end of receptacle 30 to retain or selectively retain the contents of receptacle 30 within receptacle 30. The closure generally includes sidewalls 60, a top portion 70, a handle 80, and a flap 90.

As shown in FIGS. 1A-9, sidewalls 60 of closure 20 generally form the outer periphery of closure 20 and are configured to couple to sidewalls 50 (or collar 52) of receptacle 30 (e.g., generally in the region of collar 52).

Figure 12A:
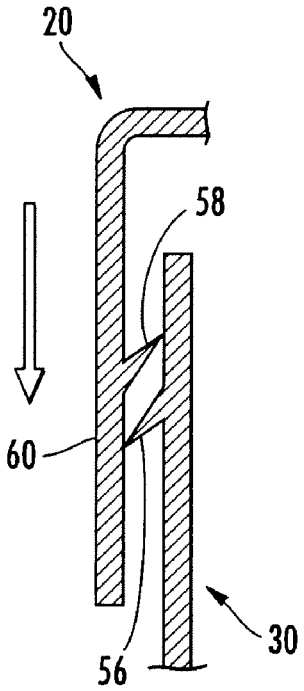
FIGS. 12A-12C illustrate partial cross-sectional views of the engagement structures on a closure and a receptacle according to an exemplary embodiment.
Figure 12B:
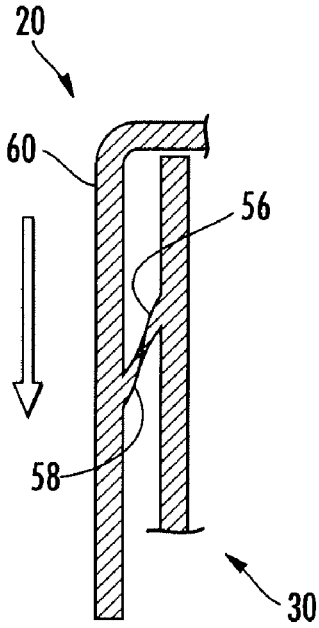
Figure 12C:
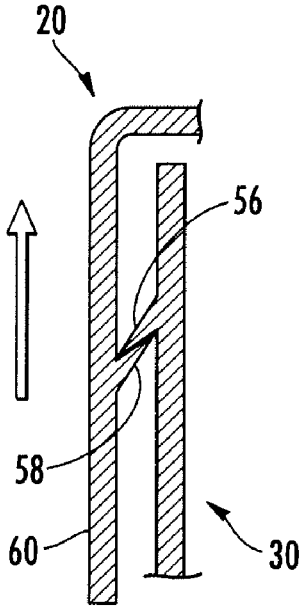
Figure 13:
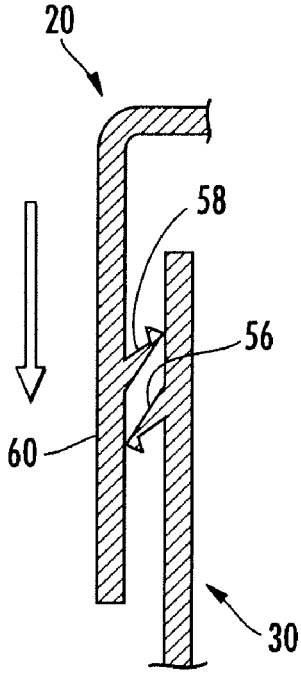
FIG. 13 illustrates a partial cross-sectional view of the engagement structures on a closure and a receptacle according to another exemplary embodiment.

As shown in FIGS. 12A-13, sidewalls 60 may include one or more projections (e.g., fingers, barbs, locking members, etc.) or recesses 58 that engage or lock with projections or recesses 56 provided on sidewalls 50 (or collar 52) of receptacle 30 to retain closure 20 in place on receptacle 30. An example of such projections or barbs 56 and 58 are provided in U.S. patent application Ser. No. 10/764,819, filed Jan. 26, 2004, which is hereby incorporated by reference in its entirety.

As shown in FIGS. 1A-9, top portion 70 couples to one end of sidewalls 60 of closure 20 to form a generally rectangular, cup-shaped member that has its opening facing receptacle 30. When closure 20 is coupled to receptacle 30, sidewalls 60 of closure 20 and sidewalls 50 of receptacle 30 may overlap so that the corresponding projections or recesses 56 and 58 (discussed above) located on sidewalls 60 of closure 20 and on sidewalls 50 of receptacle 30 engage one another to retain closure 20 on receptacle 30. Top portion 70 is generally flat and may be configured to receive bottom 40 of a like receptacle 30 that may be stacked on top of closure 20. To facilitate this stacking, top portion 70 may include one of a recess 72 and a raised region 74 that cooperates with the other one of recess 72 and raised region 74 provided on bottom 40 of receptacle 30.

As shown in FIGS. 1A-8B, closure 20 may include a handle 80 that a user may grasp to pick up container 10, pour the contents of container 10, or otherwise maneuver container 10. According to one exemplary embodiment illustrated in FIGS. 1A-1D, handle 80 may be stationary and cooperate with a recess 82 in top portion 70 to allow a user's hand to fit underneath handle 80. Handle 80 may be formed separately from closure 20 and then coupled to closure 20, or handle 80 may be integrally formed as a single unitary body with closure 20.

According to another exemplary embodiment illustrated in FIGS. 2A-2D, handle 80 may translate between an extended position in which handle 80 is spaced apart from top portion 70 of closure 20, and a retracted position in which handle 80 may be located proximate top portion 70 of closure 20. To accommodate the translational movement of handle 80, closure 20 and/or receptacle 30 (in particular, sidewalls 50 of receptacle 30 and sidewalls 60 of closure 20) may include channels 84 that are configured to guide the translational movement of handle 80. In order to allow a user to move handle 80 from the retracted position to the extended position, recess 82 may be provided in top portion 70 around and underneath handle 80 to allow a user to place his fingers under handle 80.

Figure 11:
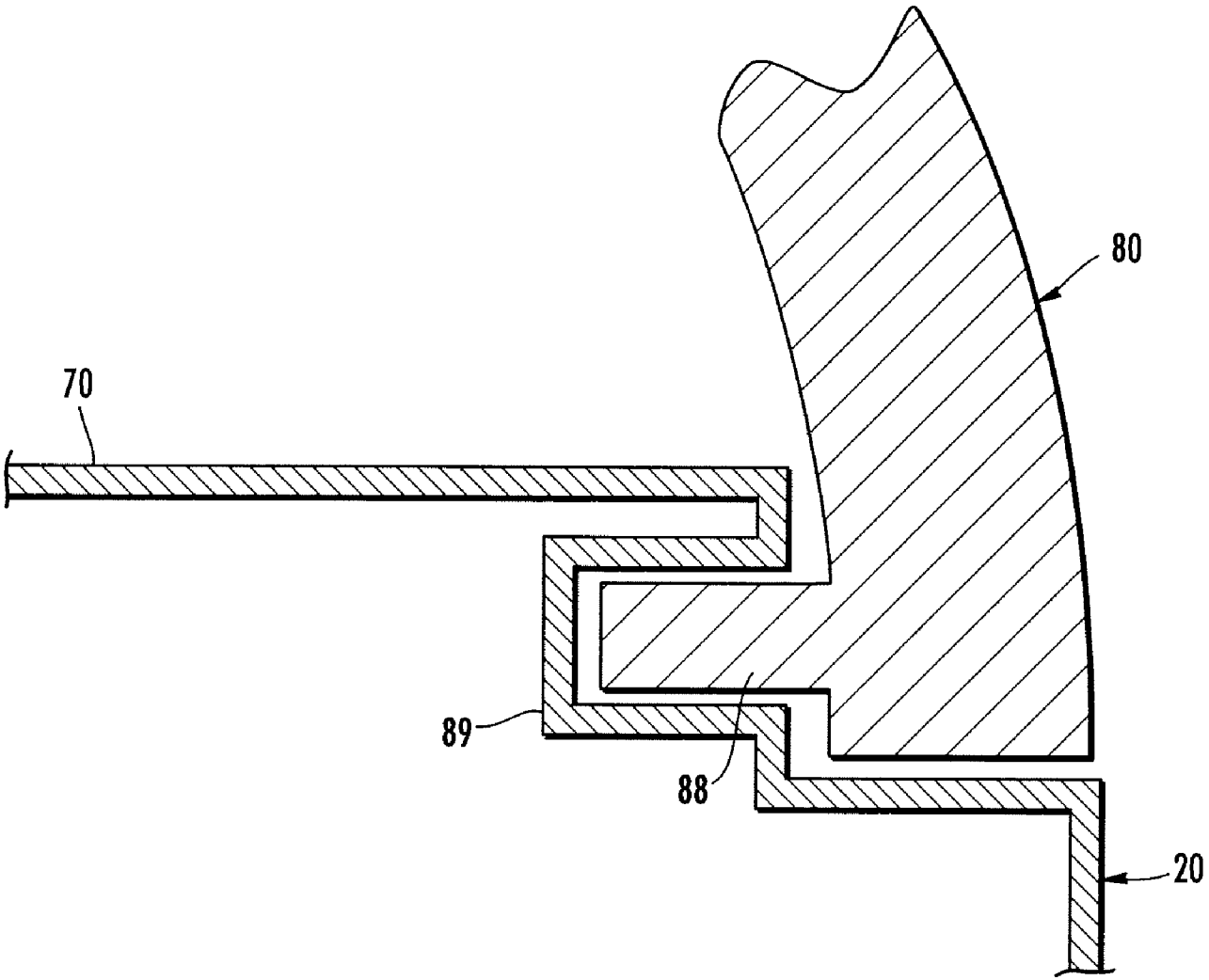
FIG. 11 is a cross-sectional view of a portion of the closure of FIG. 8B taken along line 11-11.

According to other exemplary embodiments illustrated in FIGS. 3A-8C, handle 80 may be a bail-type handle that pivots between a non-use position in which handle 80 is located proximate top portion 70 of closure 20 (and aligned generally parallel with the plane of top portion 70), and a use position in which handle 80 is rotated upward (and aligned generally perpendicular with the plane of top portion 70). Top portion 70 of closure 20 may include a recess 86 that is configured to receive handle 80 when handle 80 is in the non-use position. Recess 86 allows handle 80 to rest in a position that does not interfere (such as by extending above the general plane of top portion 70 or beyond the general periphery of closure 20) with bottom 40 of a receptacle 30 that may be stacked on top of closure 20. As shown schematically in FIG. 11, to couple handle 80 to top portion 70 or sidewalls 60 of closure 20, handle 80 may include one or more projections 88 that extend from handle 80 and that are received within corresponding recesses 89 provided in top portion 70 or sidewalls 60 of closure 20. Alternatively, handle 80 may include recesses that are configured to receive projections extending from top portion 70 or sidewalls 60 of closure 20. According to an exemplary embodiment, projections 88 and recesses 89 are substantially aligned so as to share a common axis around which handle 80 may pivot. Projections 88 and recesses 89 may be sized such that projections 88 frictionally engage recesses 89. Depending on the amount of friction between projections 88 and recesses 89, the friction may be sufficient to retain handle 80 in any position until a force sufficient to overcome the friction is applied by a user.

According to various exemplary embodiments shown in FIGS. 3A-4D and 6A-6D, the shape of handle 80 may follow the general shape of closure 20 and/or receptacle 30. According to various other exemplary embodiments shown in FIGS. 1A-2D, 5A-5D, and 7A-8C, the shape and profile of handle 80 may remain within the general shape of closure 20 and/or receptacle 30.

As shown in FIGS. 1A-9 and 14A-16C, closure 20 may include a flap 90 that moves between a closed position, in which no opening is provided in closure 20 for dispensing material within receptacle 30, and an open position, in which an opening 92 is provided that allows a user to dispense material from receptacle 30 through opening 92. Flap 90 is coupled to the body of closure 20 (e.g., sidewalls 60 and/or top portion 70) by a living hinge 94 that allows flap 90 to move between the open and closed positions. According to various exemplary embodiments shown in FIGS. 1A-8B and 15A-15C, flap 90 and living hinge 94 may be configured so that flap 90 pivots upwardly and inwardly toward the center of closure 20. According to other various exemplary embodiments shown in FIGS. 14A-14C and 16A-16C, flap 90 and living hinge 94 may be configured so that flap 90 pivots upwardly and outwardly away from the center of closure 20.

According to various exemplary embodiments shown in FIGS. 1A-5D, 7A-8B, 9, and 15A-15C, flap 90 may be located in a corner of closure 20. This has the effect of utilizing the general V-shape of the corner of closure 20 and receptacle 30 to obtain a result similar to that which would be obtained by a similarly shaped spout coupled to closure 20. The placement of flap 90 and dispensing opening 92 in the corner facilitates the dispensing of the contents of receptacle 30 in a relatively efficient and controlled manner. According to another exemplary embodiment shown in FIGS. 14A-14C, flap 90 may take the form of a flip-out spout and include side portions that help to facilitate the dispensing of the contents of receptacle 30 in a relatively efficient and controlled manner.

As shown in FIGS. 1A-9, flap 90 may be integrally formed with the other portions of closure 20. When formed, flap 90 is retained in the closed position by a "tear strip," or a strip of material 96 that is designed to be removed by the user prior to his or her use of closure 20 and/or flap 90. When closure 20 is formed, tear strip 96 is coupled to a portion of flap 90 (and may also be coupled to another portion of closure 20, such as sidewalls 60) by a relatively thin web of material. To remove tear strip 96, the user simply pulls on tear strip 96, which tears the web of material that couples tear strip 96 to flap 90 (and/or to any other portion of closure 20). To assist the user in removing tear strip 96, tear strip 96 is usually formed with a tab or free end 97 that a user can grasp to remove tear strip 96 from closure 20.

According to various exemplary embodiments, tear strip 20 may form a primary portion of the sidewalls 60 in the area of closure 20 immediately adjacent flap 90 such that removing tear strip 96 removes any portion of sidewalls 60 immediately adjacent flap 90 (see FIGS. 1A-3D and 8A-8C), or tear strip 96 may form a portion of the sidewalls 60 immediately adjacent flap 90 such that removing tear strip 96 removes only a portion of sidewalls 96 immediately adjacent flap 90 (see FIGS. 4A-7D). In the former case, tear strip 96 serves to releasably couple flap 90 to receptacle 30, whereas in the latter case, tear strip 96 serves to releasably couple flap 90 to sidewalls 60 of closure 20.

Once tear strip 96 has been removed, the user may freely open and close flap 90. In the closed position, a portion of flap 90 couples with or engages a portion of either sidewall(s) 60 of closure 20 or sidewall(s) 50 of receptacle 30 to releasably retain or lock flap 90 in the closed position. Accordingly to one exemplary embodiment, flap 90 and sidewall(s) 60 or receptacle 30 are coupled together through the use of a projection (not shown) extending from one member that engages a recess or detent (not shown) in the other member. According to another exemplary embodiment, flap 90 may be releasably retained in the closed position by frictionally engaging a portion of receptacle 30 and/or sidewall(s) 60 of closure 20.

Figure 14B:
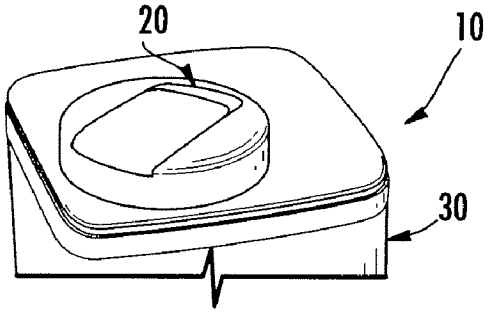
FIGS. 14A-14C illustrate different views of a closure for a container according another exemplary embodiment.
Figure 14C:
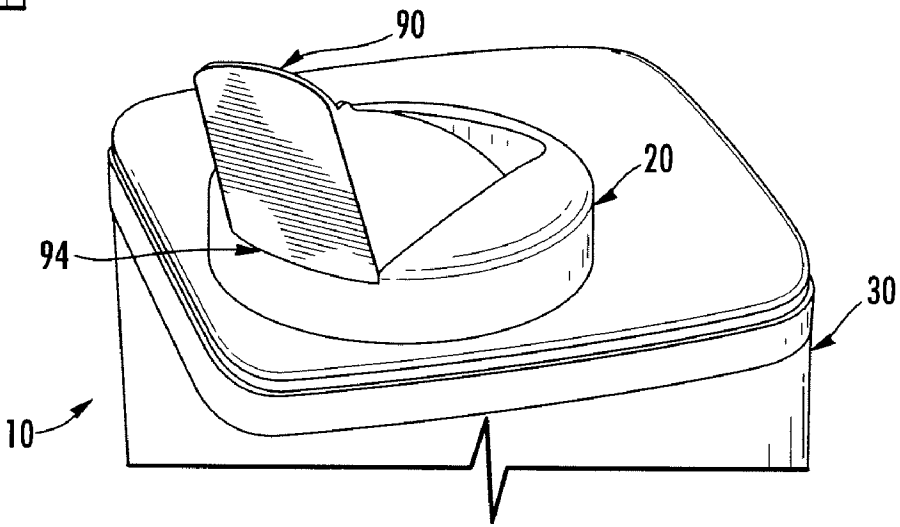
Figure 14A:
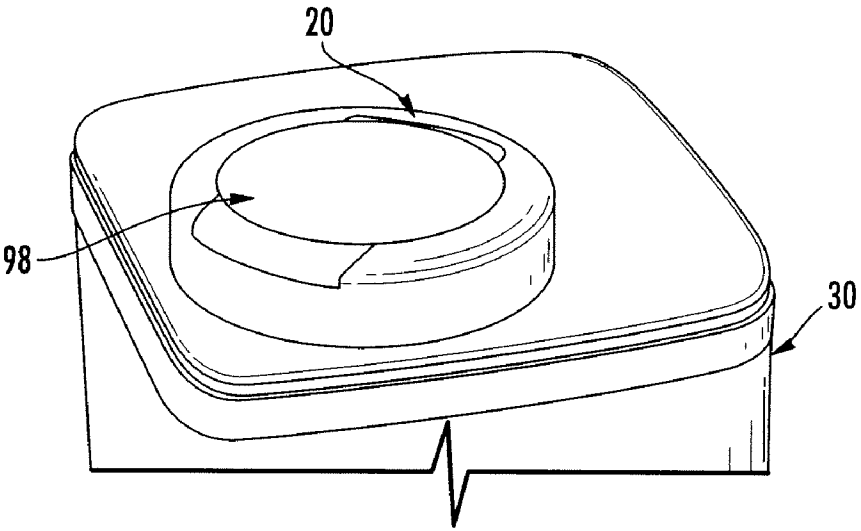
Figure 15B:
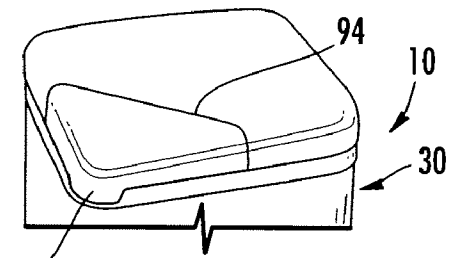
FIGS. 15A-15C illustrate different views of a closure for a container according to another exemplary embodiment.
Figure 15C:
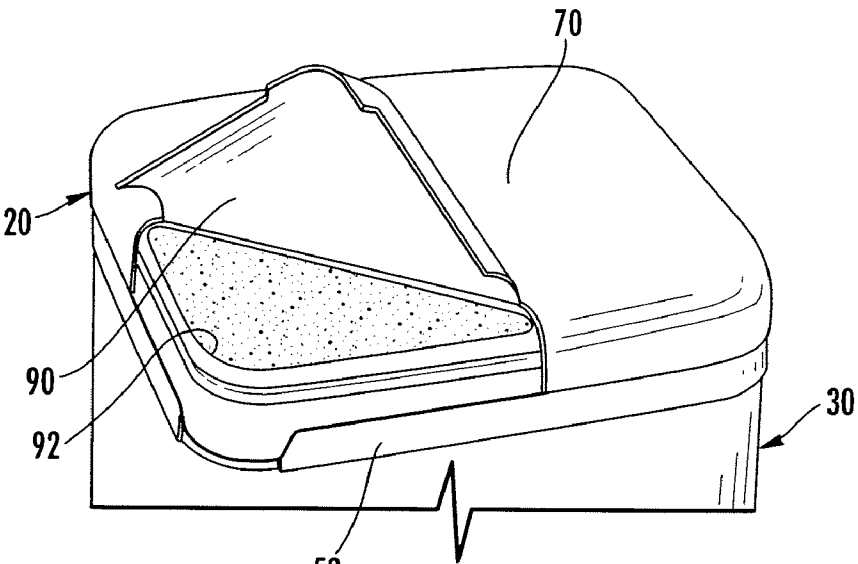
Figure 15A:
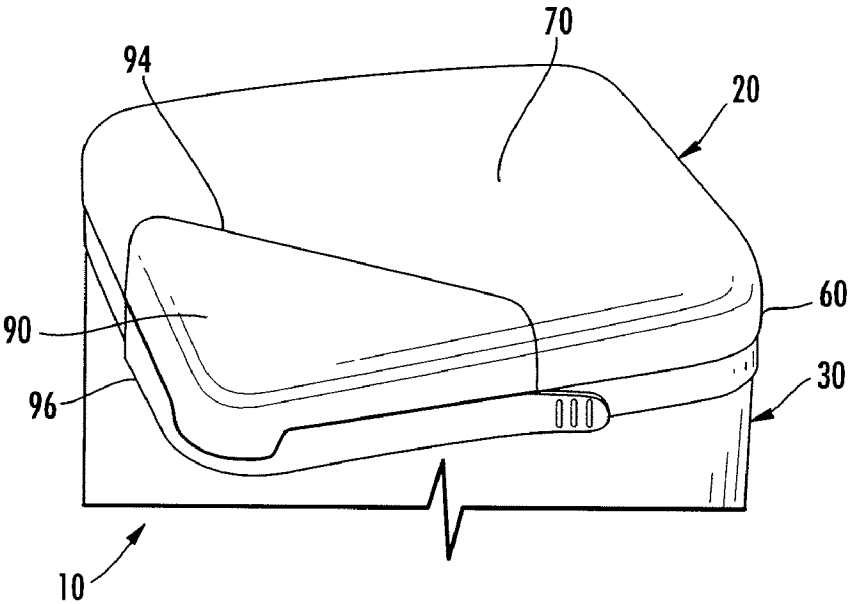
Figure 16B:
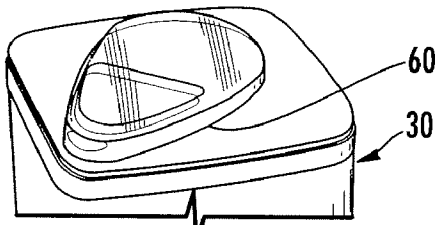
FIGS. 16A-16C illustrate different views of a closure for a container according to another exemplary embodiment.
Figure 16C:
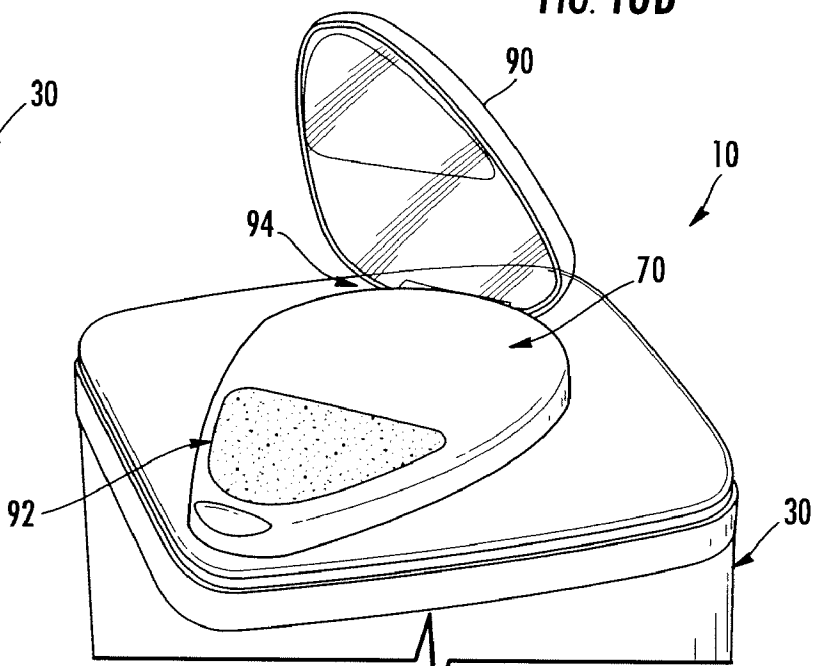
Figure 16A:
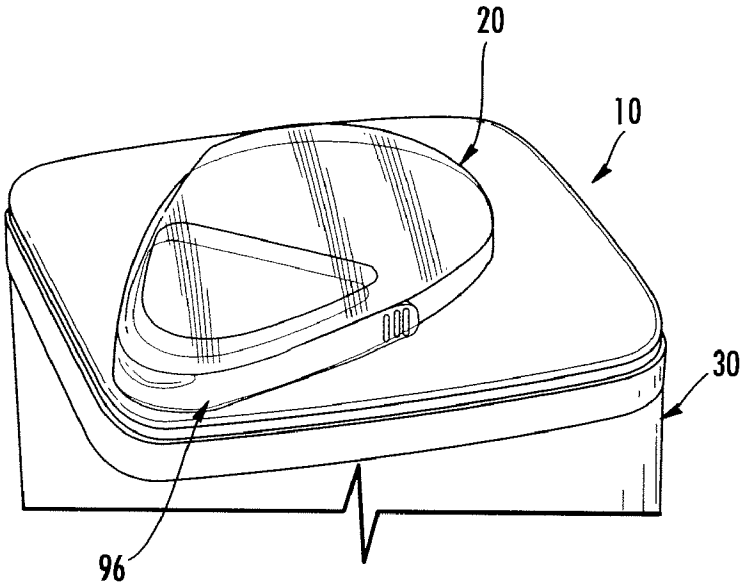

According to another exemplary embodiment shown in FIGS. 14A-14C, flap 90 may be initially retained in the closed position by a label, sticker, or cover 98 that is designed to be removed or torn by the user prior to his or her use of closure 20 and/or flap 90.

According to one exemplary embodiment, each of the closure and receptacle is integrally-formed through a molding operation. According to various exemplary embodiments, the assemblies and components of the container, including the closure and the receptacle, may be constructed from one or more separate components assembled together and may be constructed from a variety of suitable materials, including various polymers and elastomers (e.g., plastics, rubbers, etc.). Each element of the container may be made from the same material, or the different portions of the container, such as the handle, for example, may made from a different material than the other elements of the container. According to alternative embodiments, other well known processes may be used to construct the container.

It is important to note that the construction and arrangement of the elements of the container as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, angles, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or other elements of the container may be varied, and the nature or number of the projections or recesses may be varied in size, shape and configuration. It should be noted that the elements and/or assemblies of the container may be constructed from any of a wide variety of materials that provide sufficient strength, durability, or flexibility, in any of a wide variety of colors, textures and combinations. It should also be noted that the container may be used in association with a variety of materials in a wide variety of different environments and situations. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

What is claimed is:

1. A container comprising:

a receptacle comprising:

a rectangular base portion;

a sidewall portion having a lower end and an upper end, the lower end being coupled to the base portion, the upper end defining an opening; and a collar extending around the sidewall portion; and a cover coupled to the receptacle, the cover having at least one corner and comprising:

a top portion;

a skirt coupled to the top portion;

a flap coupled to the top portion at the at least one corner of the cover, the flap being moveable between an open position in which access is provided to the opening in the receptacle and a closed position in which the opening in the receptacle is closed, the flap pivoting upwardly and inwardly toward a center of the cover to achieve the open position, the flap including a closing apparatus to releasably retain the flap in the closed position; and a removable structure integrally formed with the flap and the skirt;

wherein the removable structure substantially prevents the flap from being moved into the open position until the removable structure is removed, wherein the top portion of the cover includes a raised region and wherein the base portion of the receptacle includes a recess configured to receive the raised region when the container is stacked on an identical container.

2. The container of claim 1, further comprising a handle moveable between a rest position and a use position.

3. The container of claim 2, wherein a periphery of the handle does not extend beyond the periphery of the cover when the handle is in the rest position.

4. The container of claim 2, further comprising a recess for receiving the handle when the handle is in the rest position.

5. The container of claim 1, wherein the receptacle further comprises a finger recess in the base portion configured to facilitate tipping of the receptacle and pouring the contents of the receptacle.

6. The container of claim 1, wherein the skirt includes a first engagement structure and wherein the collar of the receptacle includes a second engagement structure, the first engagement structure and the second engagement structure cooperating to releasably retain the closure and receptacle in a coupled condition.

7. The container of claim 1, wherein the flap is triangular.

8. A container comprising:

a receptacle comprising:

a rectangular base portion;

a sidewall portion having a lower end and an upper end, the lower end being coupled to the base portion, the upper end defining an opening;

a collar extending around the sidewall portion; and a plurality of ribs extending between the collar and the sidewall of the receptacle; and a cover coupled to the receptacle, the cover having at least one corner and comprising:

a top portion;

a skirt coupled to the top portion;

a flap coupled to the top portion at the at least one corner of the cover, the flap being moveable between an open position in which access is provided to the opening in the receptacle and a closed position in which the opening in the receptacle is closed, the flap pivoting upwardly and inwardly toward a center of the cover to achieve the open position, the flap including a closing apparatus to releasably retain the flap in the closed position; and a removable structure integrally formed with the flap and the skirt;

wherein the removable structure substantially prevents the flap from being moved into the open position until the removable structure is removed.

9. The container of claim 8, wherein the collar is coupled to the sidewall portion proximate the upper end of the sidewall portion.

10. The container of claim 8, wherein the cover is rectangular.

11. The container of claim 8, wherein the removable material is a tear strip.

12. The container of claim 11, wherein the tear strip comprises a tab for facilitating the removal of the tear strip.

13. A container comprising:

a receptacle comprising:

a base portion;

a sidewall portion having a lower end and an upper end, the lower end being coupled to the base portion, the upper end defining an opening; and a cover coupled to the receptacle, the cover having at least one corner and comprising:

a top portion;

a skirt coupled to the top portion;

a flap integrally formed with the top portion at the at least one corner of the cover, the flap being pivotable about an axis between an open position in which access is provided to the opening in the receptacle and a closed position in which the opening in the receptacle is closed, the flap pivoting upwardly and inwardly toward a center of the cover to achieve the open position, the flap including a closing apparatus to releasably retain the flap in the closed position; and a removable tear strip integrally formed with the flap and the skirt, the tear strip substantially preventing the flap from being moved to the open position until the tear strip is removed, the tear strip forming a portion of the skirt before being removed.

14. The container of claim 13, further comprising a handle coupled to at least one of the receptacle and the cover, the handle being moveable in a translational manner between an extended position and a retracted position.

15. The container of claim 14, wherein the handle moves in a substantially vertical direction between the extended position and the refracted position.

16. The container of claim 13, further comprising a handle coupled to at least one of the receptacle and the cover, the handle being pivotable between a use position and a stowed position about an axis that is substantially parallel to the axis of the flap.

17. The container of claim 13, wherein the closing apparatus of the flap engages the sidewall of the receptacle to releasably retain the flap in the closed position.

18. The container of claim 13, wherein the receptacle is rectangular.

19. The container of claim 13, wherein the cover is rectangular.

20. The container of claim 13, wherein the flap is triangular.

* * * * *